US007213504B2

(12) United States Patent
Rosenboom et al.

(10) Patent No.: US 7,213,504 B2
(45) Date of Patent: May 8, 2007

(54) HYDRAULIC ACTUATOR

(75) Inventors: Darin Michael Rosenboom, Orange City, IA (US); Brian D. Rosenboom, Orange City, IA (US); Ryan L. Bolkema, Hull, IA (US)

(73) Assignee: Rosenboom Machine & Tool, Inc., Sheldon, IA (US)

( * ) Notice: Subject to any disclaimer, the term of this patent is extended or adjusted under 35 U.S.C. 154(b) by 68 days.

(21) Appl. No.: 11/119,625

(22) Filed: May 2, 2005

(65) Prior Publication Data

US 2006/0243130 A1 Nov. 2, 2006

(51) Int. Cl.
*F01B 9/00* (2006.01)

(52) U.S. Cl. ..... 92/136; 92/108

(58) Field of Classification Search ..... 92/51, 92/107, 108, 136; 91/169
See application file for complete search history.

(56) References Cited

U.S. PATENT DOCUMENTS 899,795 A * 9/1908 Osmer ..... 92/136
2,678,518 A * 5/1954 Honiss ..... 83/600
2,959,156 A * 11/1960 Dreptin ..... 92/136
3,299,782 A * 1/1967 Sunday ..... 92/136
4,773,812 A * 9/1988 Bayne et al. ..... 92/136
6,626,055 B2 9/2003 Magaribuchi

OTHER PUBLICATIONS

Picture of prior art grabber with exposed gears and cylinder.
Picture of prior art grabber with rollers.

* cited by examiner

*Primary Examiner*—Michael Leslie
(74) *Attorney, Agent, or Firm*—McKee, Voorhees & Sease, P.L.C.

(57) ABSTRACT

This invention is a bi-directional hydraulic actuator comprising a piston assembly positioned within a housing. The piston assembly is configured to move linearly within the housing. A gland is operatively connected to the piston assembly. The gland is configured as a rigid longitudinally annular member with a first end, a second end, a sidewall and is open on the first end and substantially closed on the second end which forms an inside and an outside of the annular member. The gland is further configured with a lip extending from around the outside of the first end of the gland. A pressurizing fluid exerts pressure on the inside of the gland to move the piston assembly a first direction, then, a fluid exerts pressure on the outside of the gland and the lip of the gland to move the piston assembly opposite the first direction.

21 Claims, 13 Drawing Sheets

HYDRAULIC ACTUATOR

BACKGROUND OF THE INVENTION

This invention relates to hydraulic actuators. Specifically, this invention relates to a bi-directional hydraulic actuator.

Hydraulic actuators are commonly used on equipment today. Hydraulic actuators work because a force or pressure in a closed fluid system that is applied to one point is transferred to another point in the same closed system. This is typically accomplished by using an incompressible or nearly incompressible fluid. The force that is applied at one point in the system can be multiplied at another point in the system to create a very powerful force which can be used for moving mechanical devices.

One such bi-directional hydraulic actuator is shown in U.S. Pat. No. 6,626,055. In this patent the two pressure chambers receive a pressurizing fluid in either of the pressure chambers which causes the rack to move in the direction away from the pressure of the pressurizing fluid. As the rack moves, the teeth engage the teeth of a pinion gear. Thus, the linear movement of the rack creates a rotational movement of a pinion which rotates around a point in the center of the pinion.

One problem with this type of hydraulic actuator is that in order to have bi-directional motion of the rack, the pistons must be located at opposite ends of one another and thus creating a relatively long actuator assembly. Therefore, it is desirable to have a hydraulic actuator which creates bi-directional motion by having a shorter rack assembly for the same relative amount of rotational movement.

The primary objective of the present invention is to provide an improved hydraulic actuator.

Another objective of the present invention is to provide an actuator which is enclosed within a housing and thus increases the life of the actuator.

A further objective of the present invention is to create an actuator which uses rack and pinion gearing to create rotational movement on one or more mechanical arms.

A still further objective of the present invention is to create a hydraulic actuator in which greater force can be created in one direction than is created using the actuator in the opposite direction.

Yet another objective of the present invention is the provision of a hydraulic actuator which is economical to manufacture, durable in use, and efficient in operation.

A still yet another objective of the present invention is to provide an improved method of creating bi directional linear motion in a hydraulic actuator using a shorter piston assembly within an enclosed housing.

One or more of these or other objects of the invention will be apparent from the specification and claims that follow.

SUMMARY OF THE INVENTION

The foregoing objects may be achieved by a hydraulic actuator comprising a rack assembly positioned within a housing. The rack assembly is configured to move linearly within the housing. The rack assembly comprises at least one set of gear teeth. The rack assembly further comprises a rack gland operatively connected to a rack assembly. The rack gland is configured as a rigid longitudinal annular member with a first end, a second end, and a sidewall. The annular member is open on the first end and substantially closed on the second end forming an inside and an outside of the annular member. The annular member is further configured with a lip extending from the annular member around the outside of the first end. At least one pinion gear is rotatably situated within the housing so that the pinion gear contacts a set of gear teeth and rotates as the rack assembly moves linearly within the housing.

A further feature of the present invention involves a hydraulic actuator configured so that a rack assembly moves within a housing by force of oil exerting pressure on a rack gland.

A further feature of the present invention involves a hydraulic actuator wherein a portion of a pinion gear extends outside of the housing.

A further feature of the present invention involves a hydraulic actuator comprising at least one arm operatively connected to a pinion gear.

A further feature of the present invention involves a hydraulic actuator wherein a rack assembly and a rack gland are encased within a housing.

A further feature of the present invention is a hydraulic actuator wherein a rack gland is configured so that a surface area inside an end of an annular member is less than the surface area outside of the same end of the same annular member.

A further feature of the present invention involves a hydraulic actuator configured so that a fluid exerts pressures on an inside of a second end of an annular member to move a rack assembly a first direction. The actuator is further configured so that the fluid exerts pressure on the outside end of a second end of an annular member and a lip to move the rack assembly opposite the first direction.

A further feature of the present invention involves a hydraulic actuator with a second end of an annular member and a lip which are located apart from one another on the annular member.

The foregoing objects may also be achieved by a bi-directional hydraulic actuator comprising a piston assembly positioned within a housing. The piston assembly is configured to move linearly within the housing. The piston assembly comprises a gland operatively connected to the piston assembly. The gland is configured as a rigid longitudinal annular member with a first end, a second end, and a sidewall. The annular member is open on the first end and substantially closed on the second end forming an inside and an outside of the annular member. The annular member is further configured with a lip extending from the annular member around the outside of the first end.

A further feature of the present invention involves a bi-directional hydraulic actuator configured so that a fluid exerts pressure on the inside of a second end of an annular member to move a piston assembly a first direction. The actuator is further configured so that a fluid exerts pressure on the outside end of the second end of the annular member and a lip on the first end to move the piston assembly opposite the first direction.

A further feature of the present invention involves a bi-directional hydraulic actuator wherein at least one shaft or linkage is operatively connected to a piston assembly.

A further feature of the present invention involves a bi directional hydraulic actuator wherein a shaft extends outside of a housing.

The foregoing objects may also be achieved by a hydraulic clamping vehicle comprising a vehicle. The vehicle is configured with an apparatus for clamping items. The apparatus for clamping items comprises a rack assembly positioned within a housing. The rack assembly configured to move linearly within the housing. The rack assembly comprises at least two sets of gear teeth. The rack assembly further comprises a rack gland operatively connected to the rack assembly. The rack gland configured as a rigid longitudinal annular member with a first end, a second, and a sidewall. The annular member is open on the first end and substantially closed on the second end forming an inside and an outside of the annular member. The annular member further configured with a lip extending from the annular member around the outside of the first end. At least two pinion gears are rotatably situated within the housing so that the pinion gears contact the set of gear teeth and rotate as the rack assembly moves linearly within the housing. At least one arm is operatively connected to each of the pinion gears which move in a clamping motion.

The foregoing objects may also be achieved by a method of creating bi-directional hydraulic motion within a housing comprising the steps of: providing a housing, a piston assembly, a gland and a fluid; configuring the housing so that the piston assembly moves linearly within the housing; configuring the gland as a rigid longitudinal annular member with a first end, a second end, and a sidewall; further configuring the annular member as open on the first end and substantially closed on the second end, forming an inside and an outside of the annular member; further configuring the annular member with a lip extending from the annular member around the outside of the first end operatively connecting the gland to the piston; exerting fluid under pressure on the inside of the second end of the annular member to move the piston assembly a first direction; and, exerting fluid under pressure on the outside end of the second end of the annular member and the lip to move the piston assembly opposite the first direction.

A term that needs to be defined for this invention is a gland. A gland for the purpose of this invention is a sliding machine part designed to slide when a greater fluid force is exerted on one side of the gland than is exerted on the other side of the gland.

This invention discusses a rack assembly operatively connected to a gland. In addition, this invention discusses a piston operatively connected to a gland. The two devices work the same. The difference is that a rack assembly has gear teeth on one or more sides of the assembly whereas the piston does not. Both the rack assembly and the piston can be configured as one piece with the gland or assembled together from multiple parts.

The term equipment for the purposes of this invention means any equipment, stationary or mobile, which utilizes fluid power. Fluid power encompasses hydraulics as well as pneumatics. The preferred embodiment of this invention utilizes hydraulics, however pneumatics are also considered by this invention even though the pneumatic fluid is easily compressible. Additionally, the terms fluid, oil or hydraulic refer to any fluid, liquid or gas.

Additionally, the term vehicle as contemplated for this invention can be on road, off road, land, sea, air, or space vehicles.

DETAILED DESCRIPTION OF THE PREFERRED EMBODIMENT

The hydraulic actuator of the current invention is best used for grabbing or grappling objects. However, it can be used for numerous other purposes. The preferred embodiment of the current invention works like a rack and pinion rotary actuator where there is a pinion on each side of a double-sided rack. This makes the pinions rotate in opposite directions.

A unique feature of this invention is how the rack is translated with fluid in a very compact space. Inside the rack, is essentially a double displacement linear actuator that nests inside itself to reduce the working space required. As fluid is displaced into the chamber on one side or the other of the nesting diameters internal to the rack, the rack displaces in that direction when used as a grabber assembly, this causes the gears to rotate and either grip or open up a grabber.

The current invention is shown in FIGS. 1–6 and 8–9 as a two-sided device. However it is also contemplated that the current invention could be three-sided, four-sided or any number of sides which are necessitated. For example, a three or four-sided arm grapple could be used on devices such as those on cranes or logging equipment (see FIG. 7) to pick up debris, logs, or etc.

Figure 1:
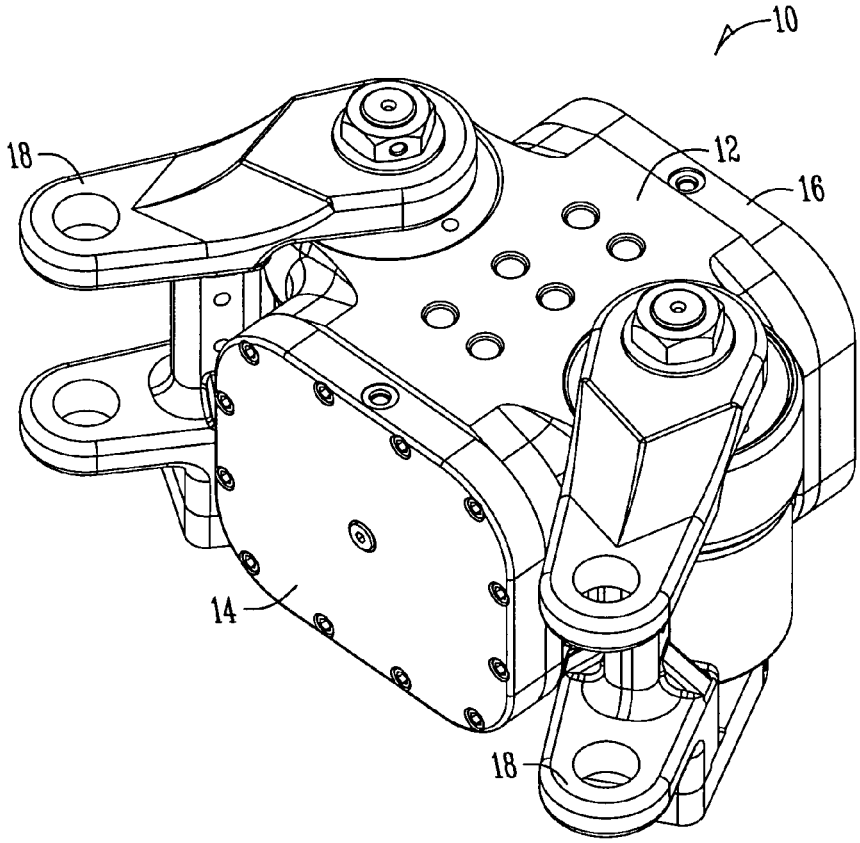
FIG. 1 shows a three dimensional view of one embodiment of the hydraulic actuator.
Figure 2:
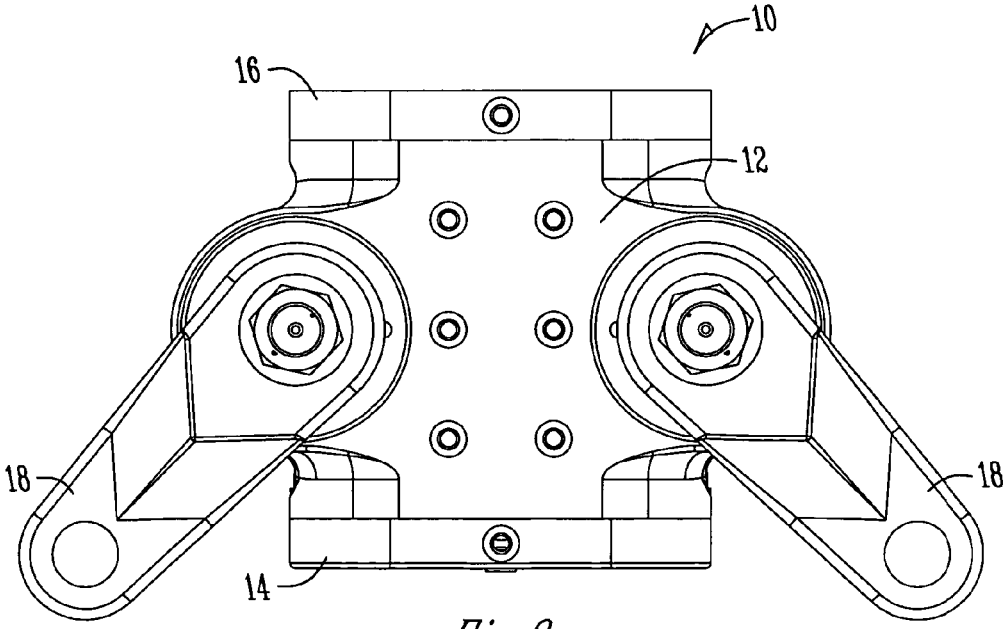
FIG. 2 shows a top view of one embodiment of the hydraulic actuator.

FIGS. 1 and 2 show one embodiment of the hydraulic actuator assembly 10. FIG. 1 shows a three-dimensional view of the hydraulic actuator 10, whereas FIG. 2 shows a top view of the same actuator 10. In this embodiment, the housing 12 encloses the device with the aid of a front end cap 14 and a back end cap 16. It is preferred that the housing 12 and the front end cap 14 and the back end cap 16 be constructed from any rigid material which can be cast, molded, milled, or other manufacturing process which can put the device in proper form.

This embodiment of the hydraulic actuator assembly 10 shows two arms 18 extending out beyond the housing 12.

When the hydraulic actuator assembly 10 is operated, the arms 18 pivot in a back and forth motion. The actuator assembly 10 can be configured with one or more of the arms 18. When two or more arms 18 are used on a single actuator 10, the device can be used for grabbing or grappling items.

Figure 3:
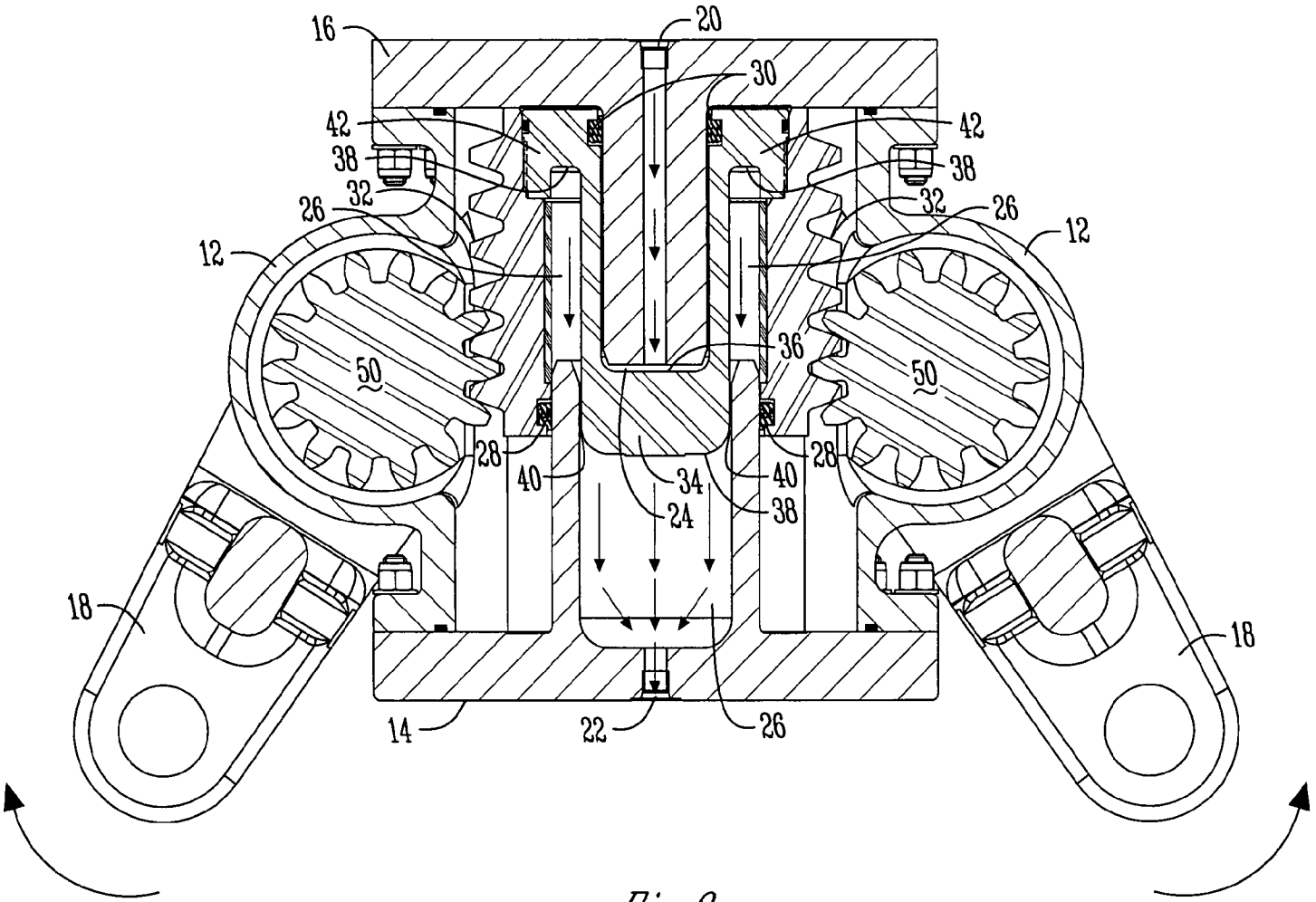
FIG. 3 shows a cut-away view showing the interior of one embodiment of the hydraulic actuator with the arms at zero rotation.
Figure 4:
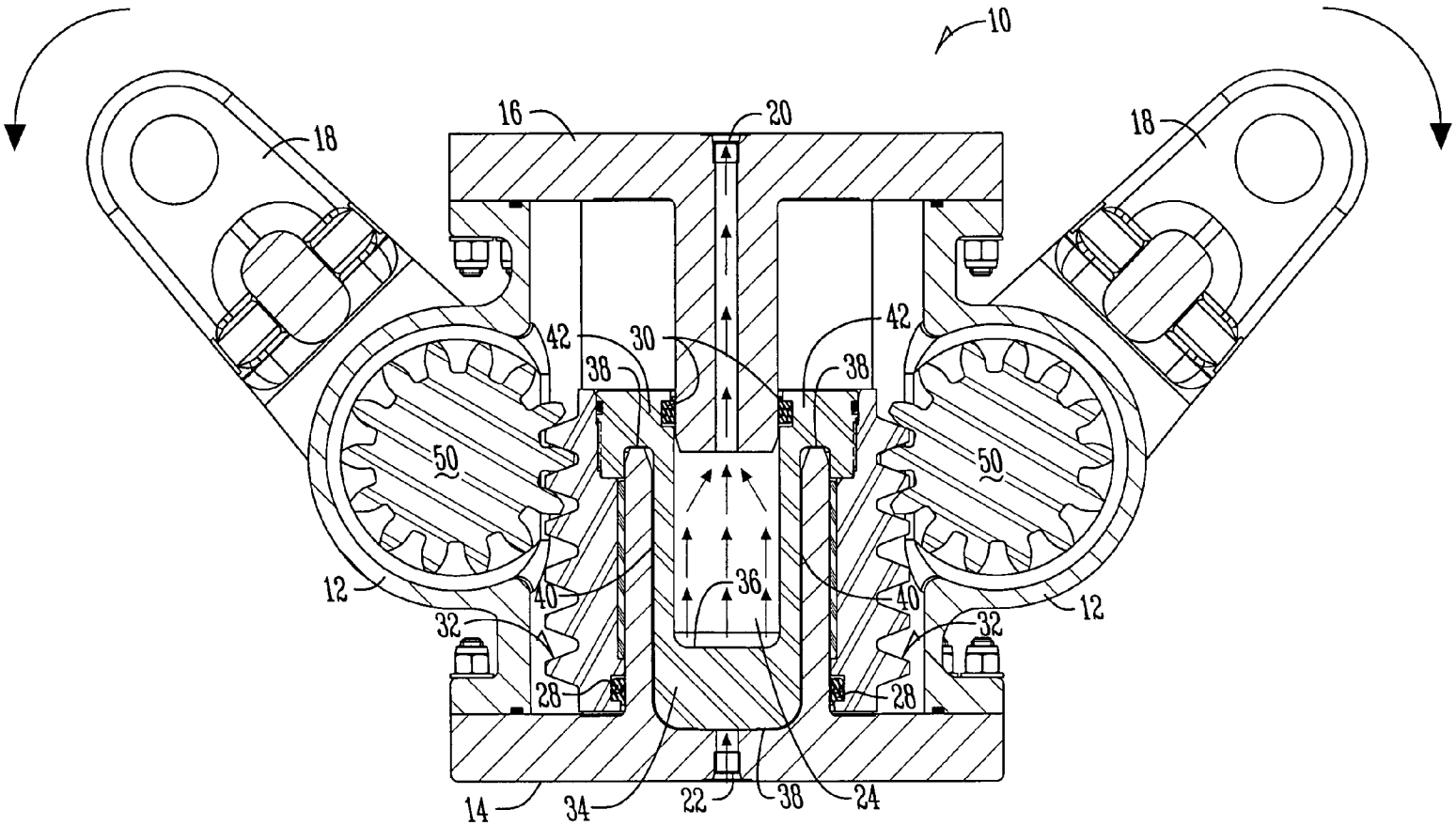
FIG. 4 shows a cut-away view of one embodiment of the hydraulic actuator with the arms at full rotation.
Figure 5:
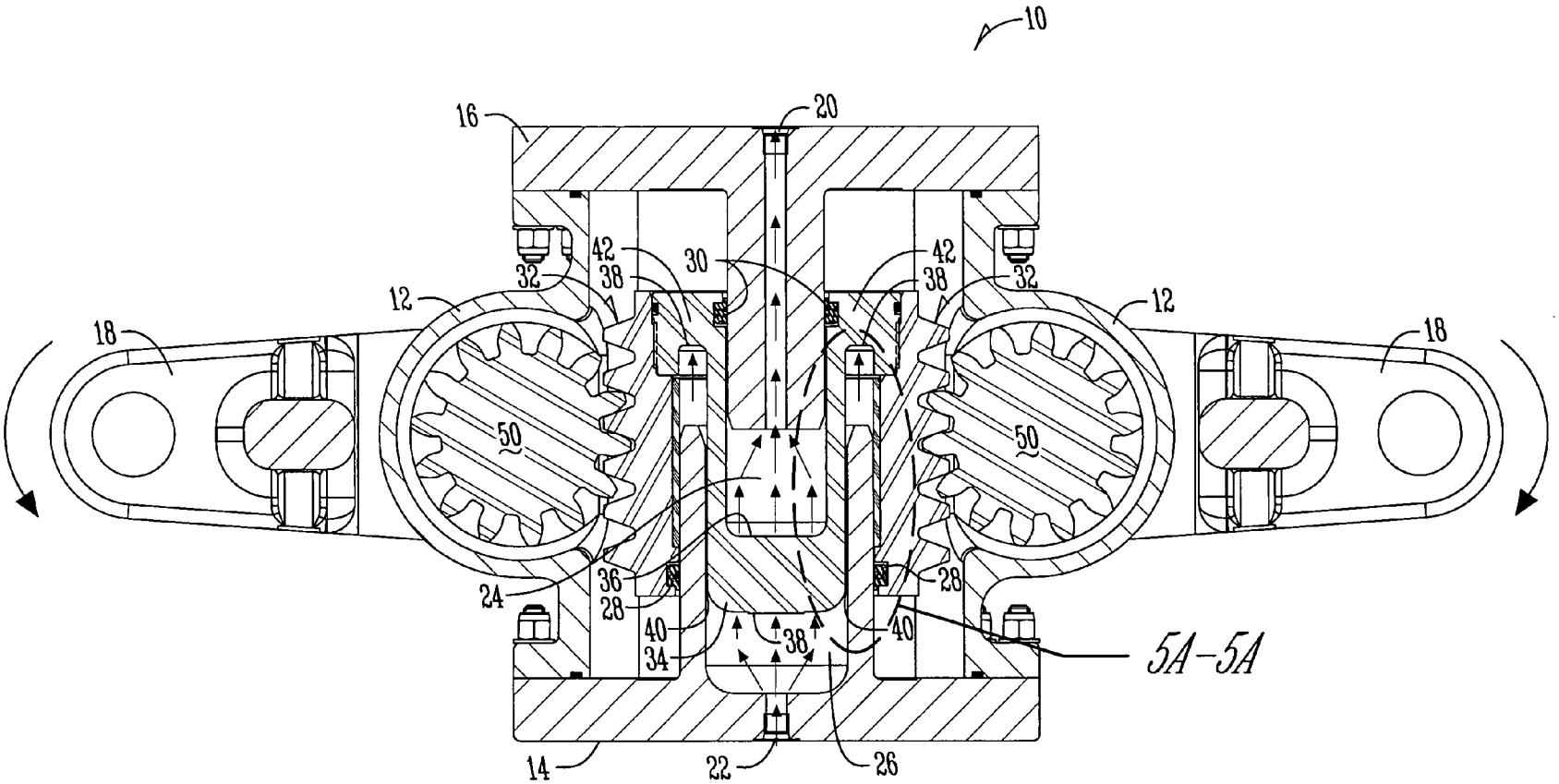
FIG. 5 shows a cut-away view of one embodiment of the hydraulic actuator with the arms at half rotation.
Figure 5A:
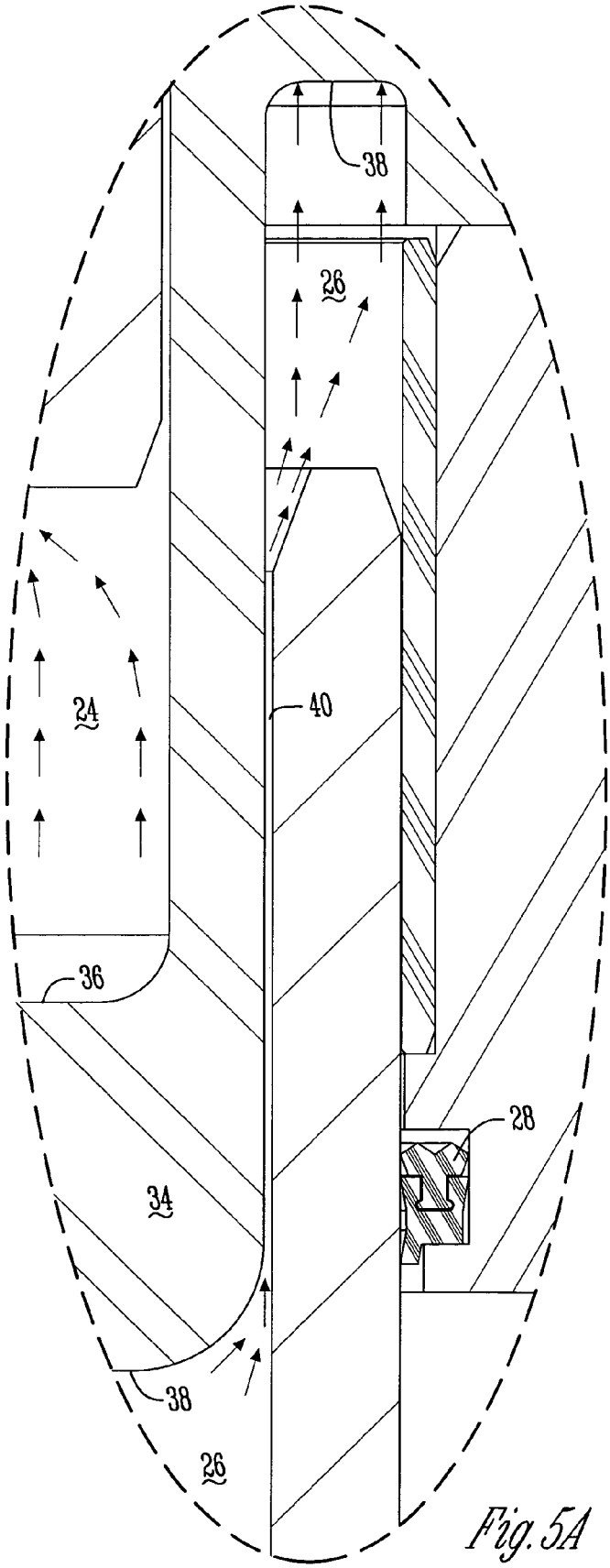
FIG. 5A shows an enlarged view of the oil channel.

FIGS. 3, 4 and 5 show a cut-away version of one embodiment of the hydraulic actuator assembly. FIG. 3 shows the arms 18 in a not-rotated position. FIG. 4 shows the arms 18 fully rotated. FIG. 5 shows the arms 18 half way through the rotation. FIG. 5A shows an enlarged view of the oil channel 40.

The rack 32 is operatively connected or otherwise affixed to the rack gland 34. This assembly moves in a linear motion within the housing 12.

The motion of the rack 32 and rack gland 34 assembly is created when a pressurizing fluid, such as hydraulic fluid, is pushed through the oil tube 20 which is located through the back end cap 16. Once the pressurizing fluid flows through the oil tube 20 it enters the small area oil chamber 24 and applies a pressure against the small gland surface 36. The force of the pressurizing fluid flowing into the small area oil chamber 24 is greater than the force of a fluid in the large area oil chamber 26. This pressure causes the rack 32 and rack gland 34 to move away from the pressure created in the small area oil chamber 24. This movement displaces the existing fluid in the large oil chamber 26 out through the oil tube 22 in the front end cap 14. The pressure fluid within the small area oil chamber 24 and the large area oil chamber 26 is contained within these chambers 24 and 26 by the use of seals 30, and 28 and O-ring 88. Additional seals may be necessary if parts are made in multiple pieces. For example, the front cap 14 and the back cap 16 can be created from multiple pieces instead of a single piece. Therefore seals are needed between the pieces to prevent leakage where the multiple parts join together.

When the rack 32 and rack gland 34 move linearly within the housing 12, teeth on the rack 32 engage teeth on the gears 50. The farther the rack 32 moves the more the gears 50 are rotated about an axis created by bearings 52. This, in turn, causes the arms 18, which are connected to the gears 50, to rotate.

The rack 32 and rack gland assembly 34 move in an opposite direction within the housing 12 when pressurizing fluid which is of a greater force flows through the oil tube 22 and into the large area oil chamber 26 and applies pressure against the large gland surface 38. This displaces the rack 32 and rack gland 34 assembly to push the fluid which is applying pressure to the small gland surface 36 in the small area oil chamber 24 out through the oil tube 20. The displacement of the rack 32 again causes the gears 50 to rotate in an opposite direction. This, in turn, causes the arms 18 to rotate in an opposite direction.

Figure 6:
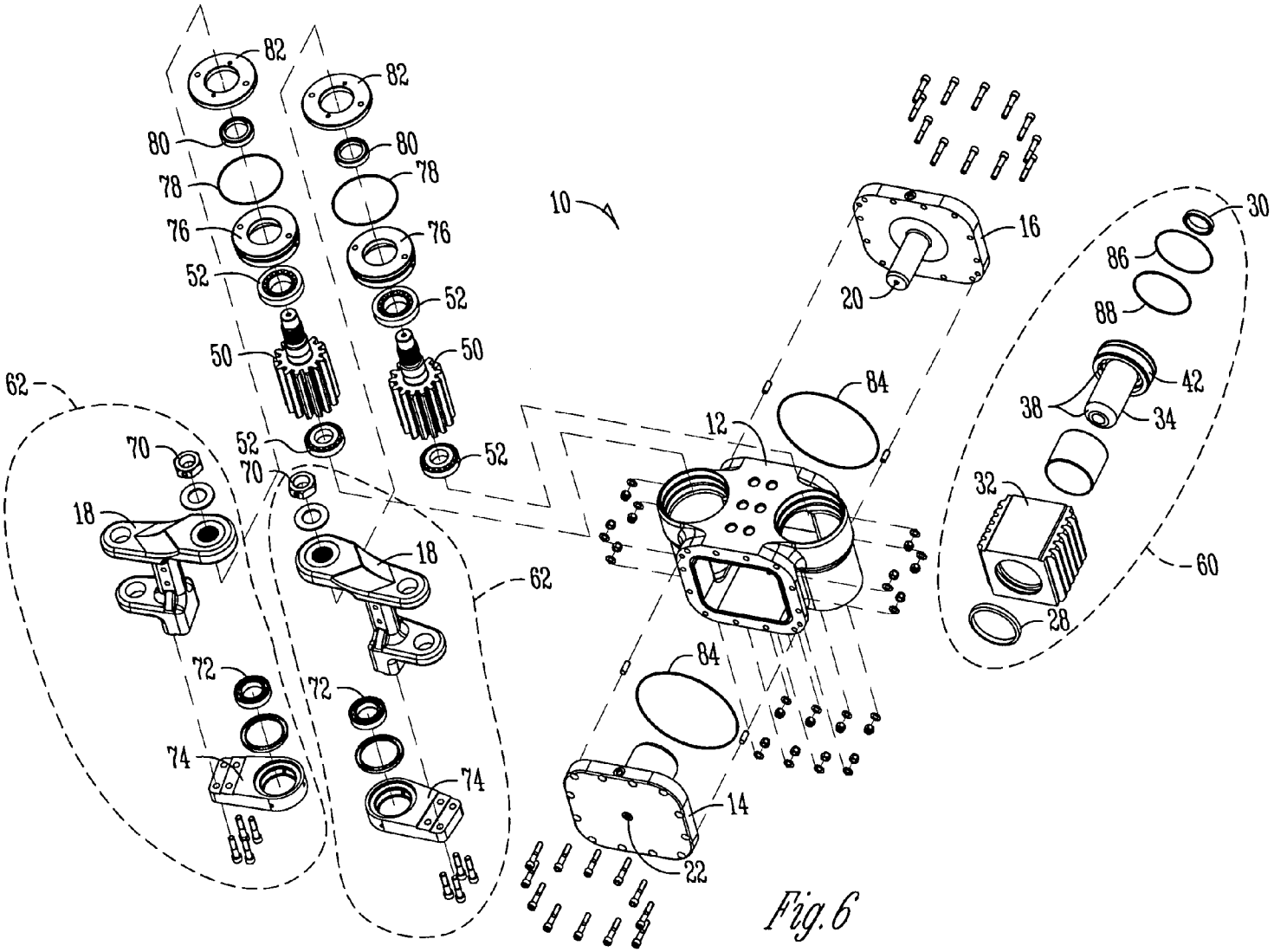
FIG. 6 shows an expanded view of one embodiment of the hydraulic actuator.

The preferred shape of the rack gland 34 for this embodiment of the invention can be seen in the expanded view drawing of FIG. 6. It is preferred that the rack gland 34 be a hollow cylindrical tube closed on one end and open on the other with a rack gland lip 42 extending from the cylinder around the outside of the open end of the rack gland 34. However, any shape which creates a longitudinal annular member is acceptable. Additionally, the rack gland 34 can be made from multiple pieces.

The shape of the rack gland 34 allows the rack assembly 60 to nest inside of the front end cap 14 and the back end cap 16. In addition, the pressurizing fluid can flow in the oil channel 40 between the front end cap 14 and the rack gland 34 thereby also creating pressure on the rack gland lip 42 at the large gland surface area 38.

It is commonly known in hydraulics that the larger the surface area the larger the force which can be created by a pressurizing fluid exerting pressure on the surface area. Thus, with the rack gland 34 of the current invention which has a small gland surface area 36 and a large gland surface area 38 nested within one another a smaller force can be created forcing the rack gland 34 in one direction using the small gland surface area 36 and a larger force can be developed using pressurizing fluid against the large gland surface 38. The surface areas of the two surfaces 36, 38 are different. It is a greater force caused by the pressure acting on the working area which causes a net force in one direction or the other. For example, the working surface area for the large gland surface 38 can be 9.621 $in^2$ (based on 3.5" diameter) and the working surface area for the small gland surface 36 can be 2.405 $in^2$ (based on 1.75" diameter). This is an area ratio of 4:1. Therefore, a pressure of 1000 psi on the large gland surface 38 is a force of 9621 lb., but a pressure of 1500 psi on the small gland surface 36 is 3608 lb. The pressure is higher on the small size, but more force on the large side creates a net force in that direction. However, any dimensions can be used to vary forces.

This hydraulic actuator assembly 10 can be created within a considerably smaller axial length than prior hydraulic actuators creating bi-directional motion because the pressure surface areas 36 and 38 nest within one another. In addition, this embodiment of the current invention allows for all of the hydraulic moving parts to be located within the housing 12, with the one exception being a portion of the gear 50 extending beyond the housing 12. This creates a much more durable product which can be used in harsh environments. In addition, the enclosed housing design of the current invention allows for lubricating fluid to be within the housing. This lubricates the gears, bearings and etc. which prolongs the life of the actuator.

Again looking to FIG. 6, we see the expanded view of one embodiment of the current invention. The rack assembly 60 is shown with the above-mentioned parts plus an O-ring 88 which is used to prevent leakage of the pressurizing fluid. Depending on the pressures to be developed, an additional back-up ring 86 can be used with the current invention.

This embodiment of the invention shows two arm assemblies 62 which attach to the gears 50. However, any type of mechanical device can be connected to the gears 50 for rotating. The jam nut 70 holds the arm 18 firmly to the gear 50. Additionally, a bearing 72 and tang 74 mount to the arm 18 and give strength to the arm assembly 62 for rotating on the bearings 72 and the gear bearings 52. Furthermore, the bearing cap 76 and locking cap 82 function to hold in the bearings 50 within the housing 12 and allow the bearings 50 to rotate or pivot within the housing 12. The O-rings 84 and the O-ring 78 and pin seal 80 are used to keep the invention from leaking lubricating fluid outside of the housing 12.

The hydraulic actuator of the current invention can be used for creating both linear motion along the same plane as the piston/gland assembly 60, extending outside of the housing through the housing 12 and/or front cap 14, and/or the back cap 16, or rotational motion about the bearings 52. This suits the hydraulic actuator of the current invention well for many applications.

A few examples of applications for the current invention are shown in FIGS. 7, 8 and 9. However, numerous other applications of the current invention are available and should not be limited in any way by the given examples. For example, hydraulic actuator assembly 10 is shown configured with both two arm 110 and four arm 100 assembly configurations. However, any number of armed assemblies 62 can be used with the current invention. Additionally, the hydraulic actuator assembly 10 of the current invention can be used on any type of application. The hydraulic actuator assembly 10 is shown being used on vehicles, however, the hydraulic actuator assembly 10 can be used on apparatuses other than vehicles. As an example, the hydraulic actuator assembly 10 can be used on parts handling equipment, waste crushing equipment, or any other type of equipment.

FIGS. 7A through 7E show exemplary four-arm grabber assemblies 100. These assemblies 100 have grabber arms 102 which connect to the arm assembly 62 of the hydraulic actuator assembly 10. The four-arm grabber assembly 100 can then be connected to the vehicle or machine with connecting structure arms 104.

Figure 7A:
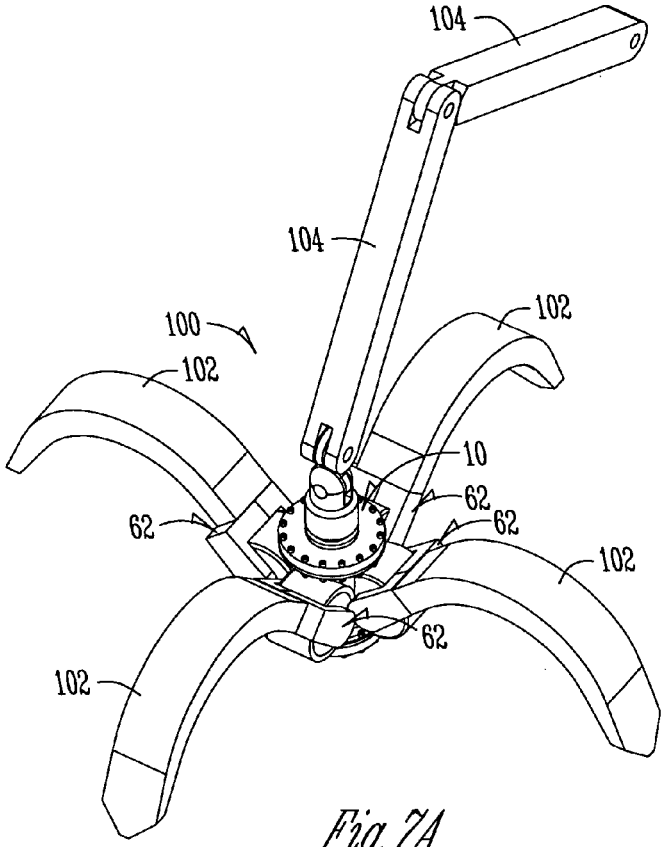
FIG. 7A shows one embodiment of a four-arm grabber assembly open using the hydraulic actuator.
Figure 7B:
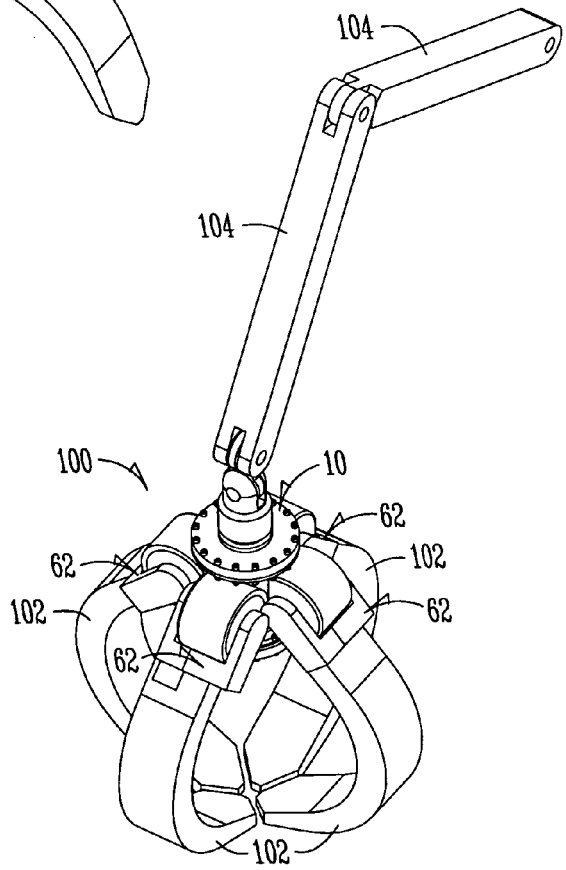
FIG. 7B shows one embodiment of a four-arm grabber assembly closed using the hydraulic actuator.
Figures 7C, 7D:
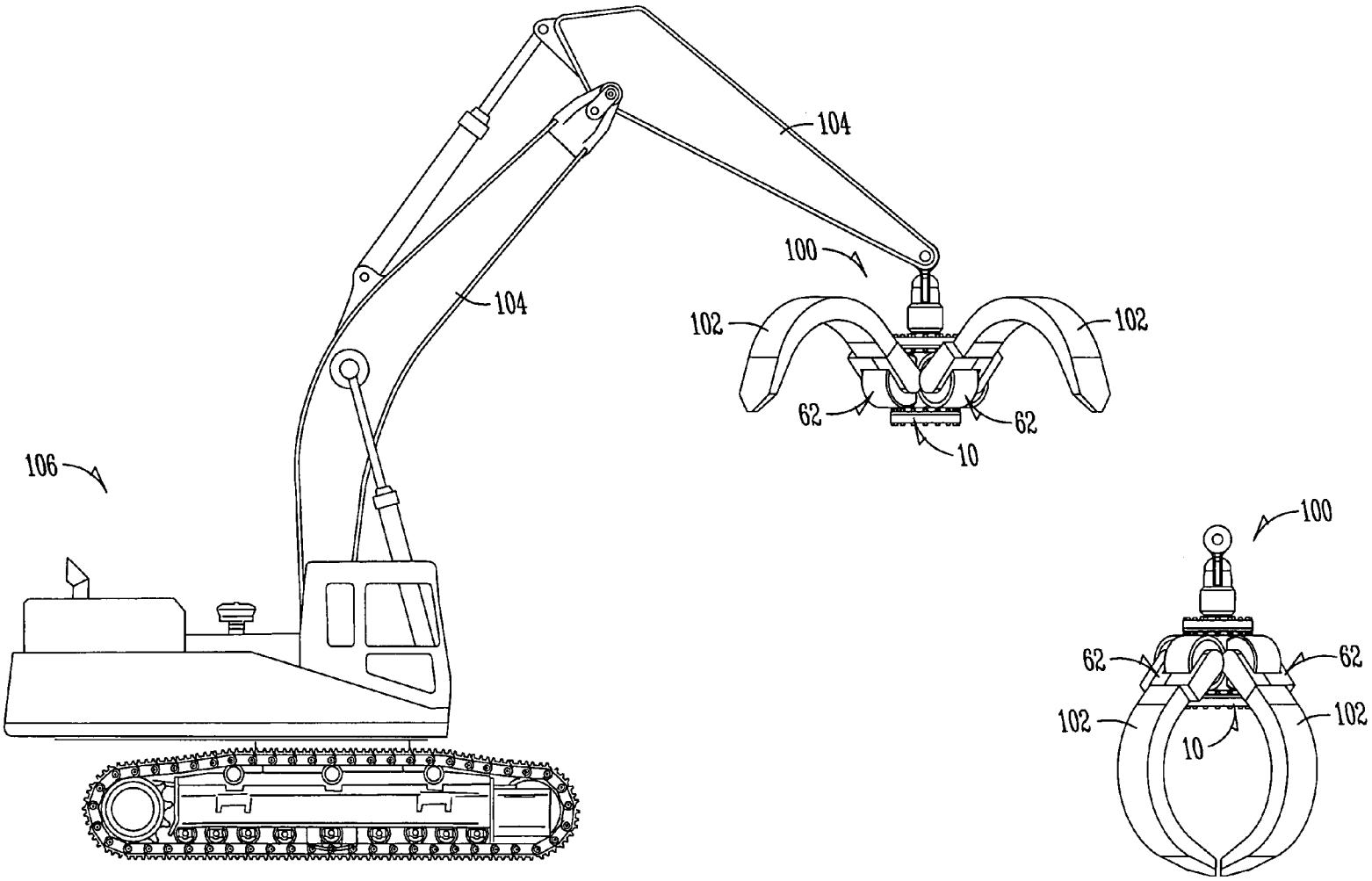
FIG. 7C shows one embodiment of a vehicle using a four-arm grabber assembly with the hydraulic actuator.
FIG. 7D shows another embodiment of a four-arm grabber assembly closed using the hydraulic actuator.

FIG. 7A shows a four-arm grabber assembly 100 in an open position. FIG. 7B shows the same four-arm grabber assembly 100 in a closed position. FIG. 7C shows an exemplary four-arm grabber vehicle 106 utilizing the four-arm grabber assembly 100. Similarly, FIG. 7D shows a four-arm grabber assembly 100 in a closed position which can be attached to a four-arm grabber vehicle 106.

Figure 7E:
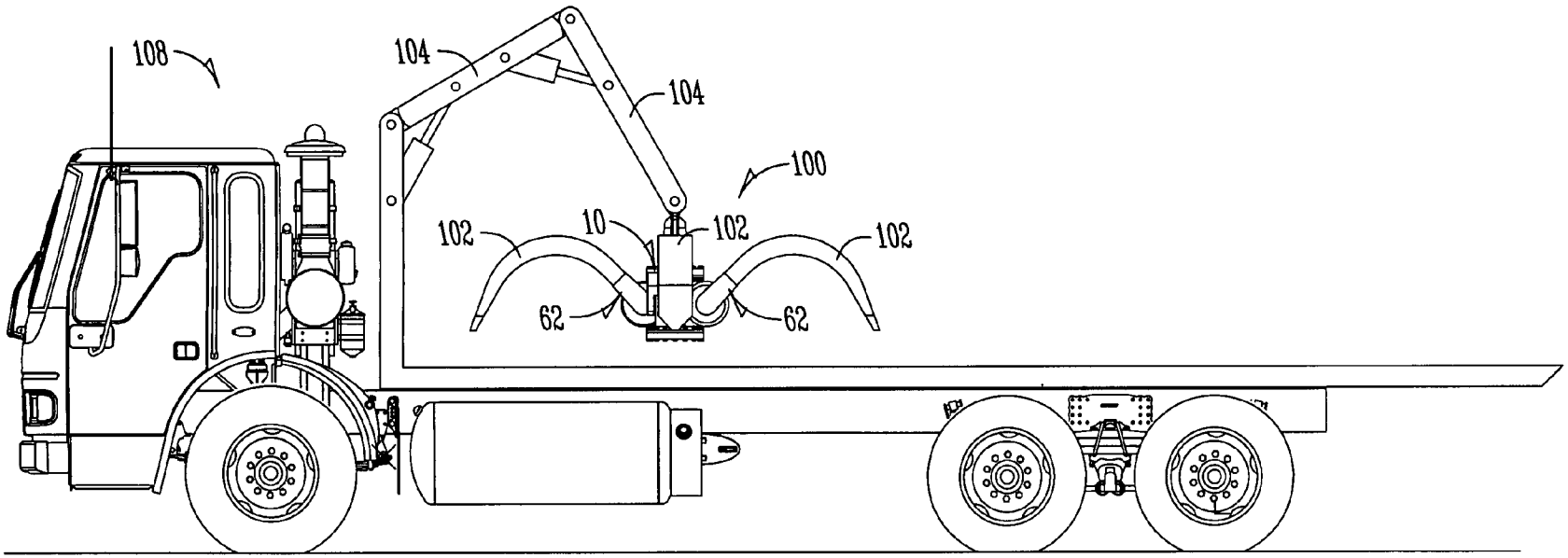
FIG. 7E shows another embodiment of a vehicle using a four-arm grabber assembly with the hydraulic actuator.

Another example of a four-arm grabber vehicle 108 is shown in FIG. 7E.

Figure 8A:
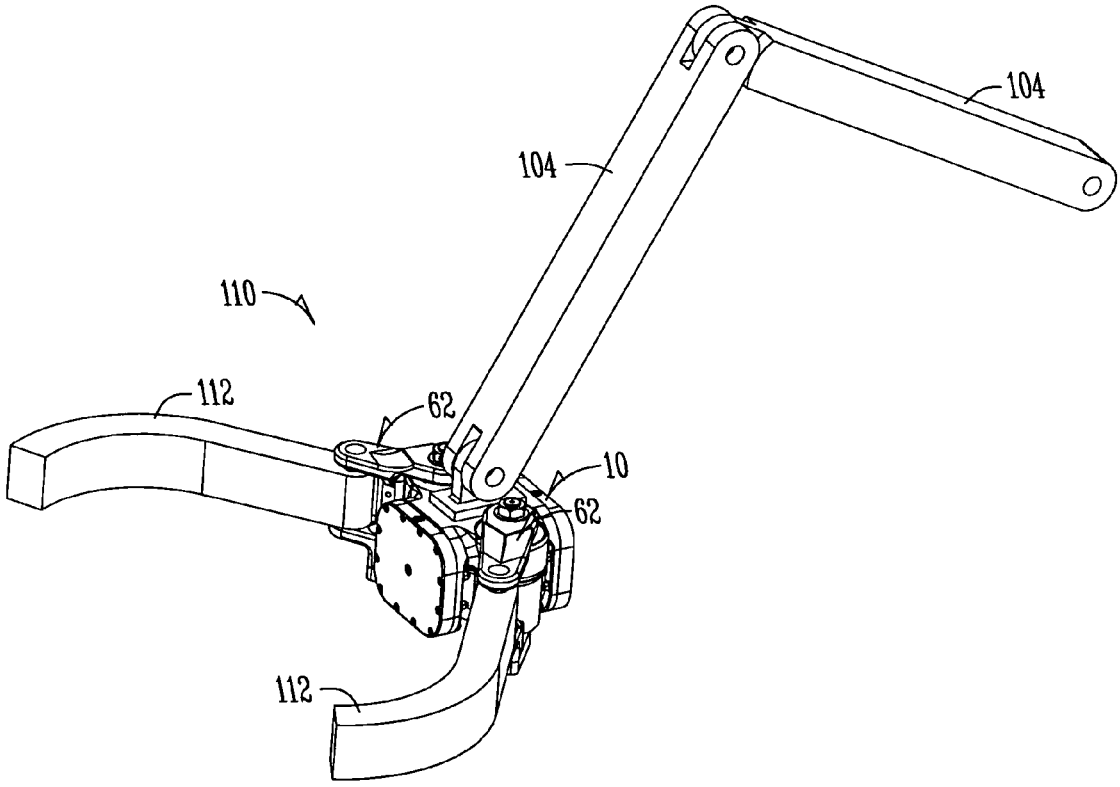
FIG. 8A shows one embodiment of a two-arm grabber assembly using the hydraulic actuator.
Figure 8B:
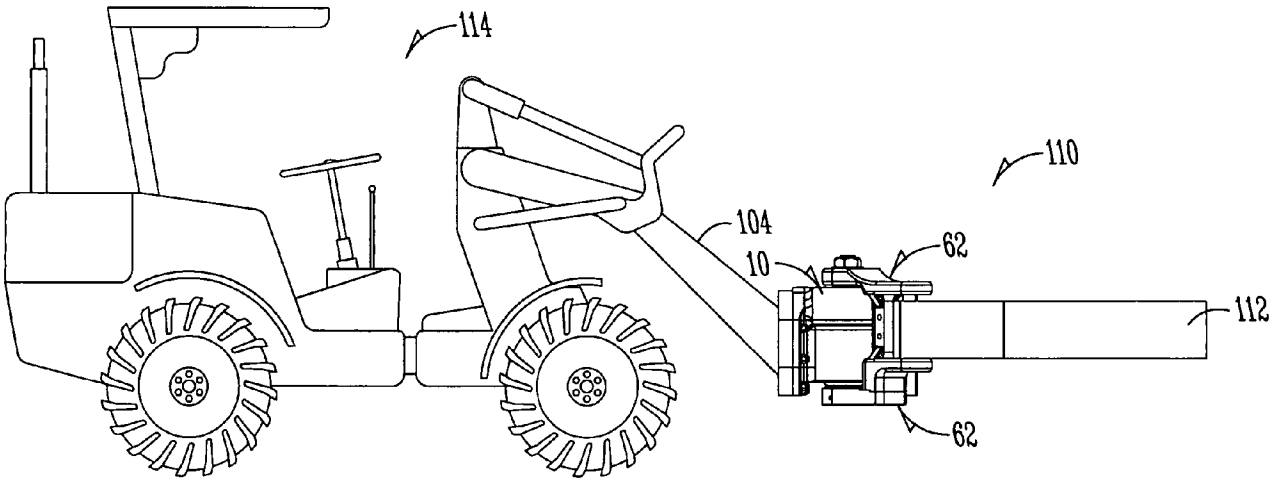
FIG. 8B shows a side view of one embodiment of a vehicle with a two-arm grabber assembly using the hydraulic actuator.
Figure 8C:
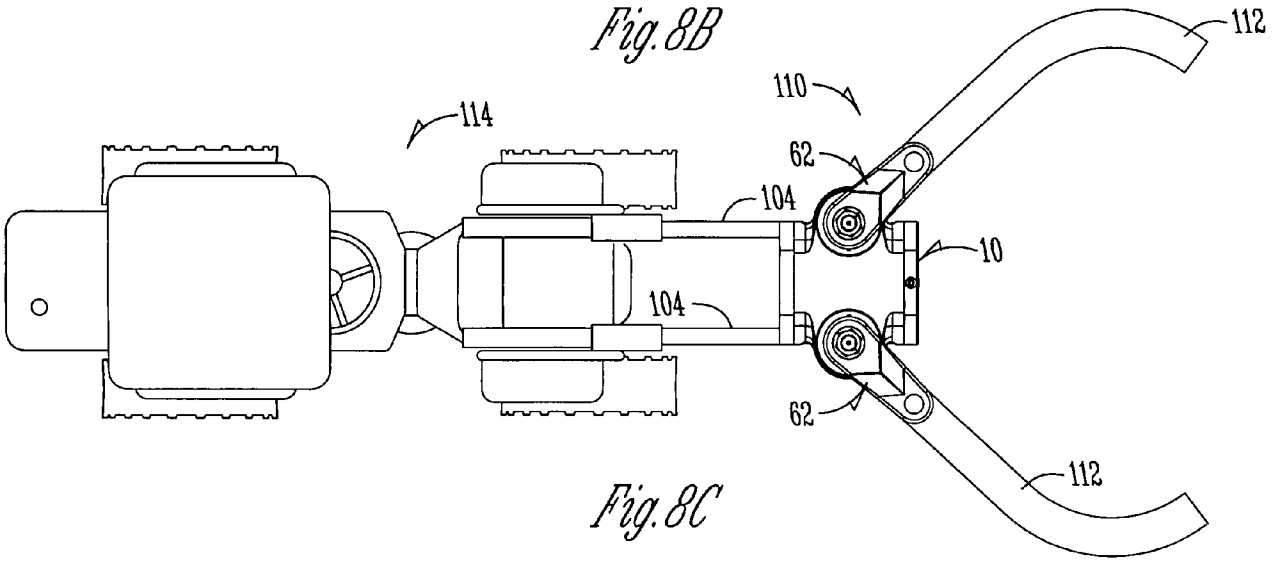
FIG. 8C shows a top view of one embodiment of a vehicle with a two-arm grabber assembly using the hydraulic actuator.

Embodiments of the two-arm grabber assembly 110 are shown in FIGS. 8A through 8C. For the two-arm grabber assembly 110 two grabber arms 112 are operatively connected to the arm assemblies 62 of the hydraulic actuator assembly 10. The two-arm grabber assembly 110 can then be connected to a machine or vehicle by the use of the connecting structure arms 104.

FIGS. 8B and 8C show a side and top view respectively of one embodiment of a vehicle 114 utilizing the two-arm grabber assembly 110.

Figure 9A:
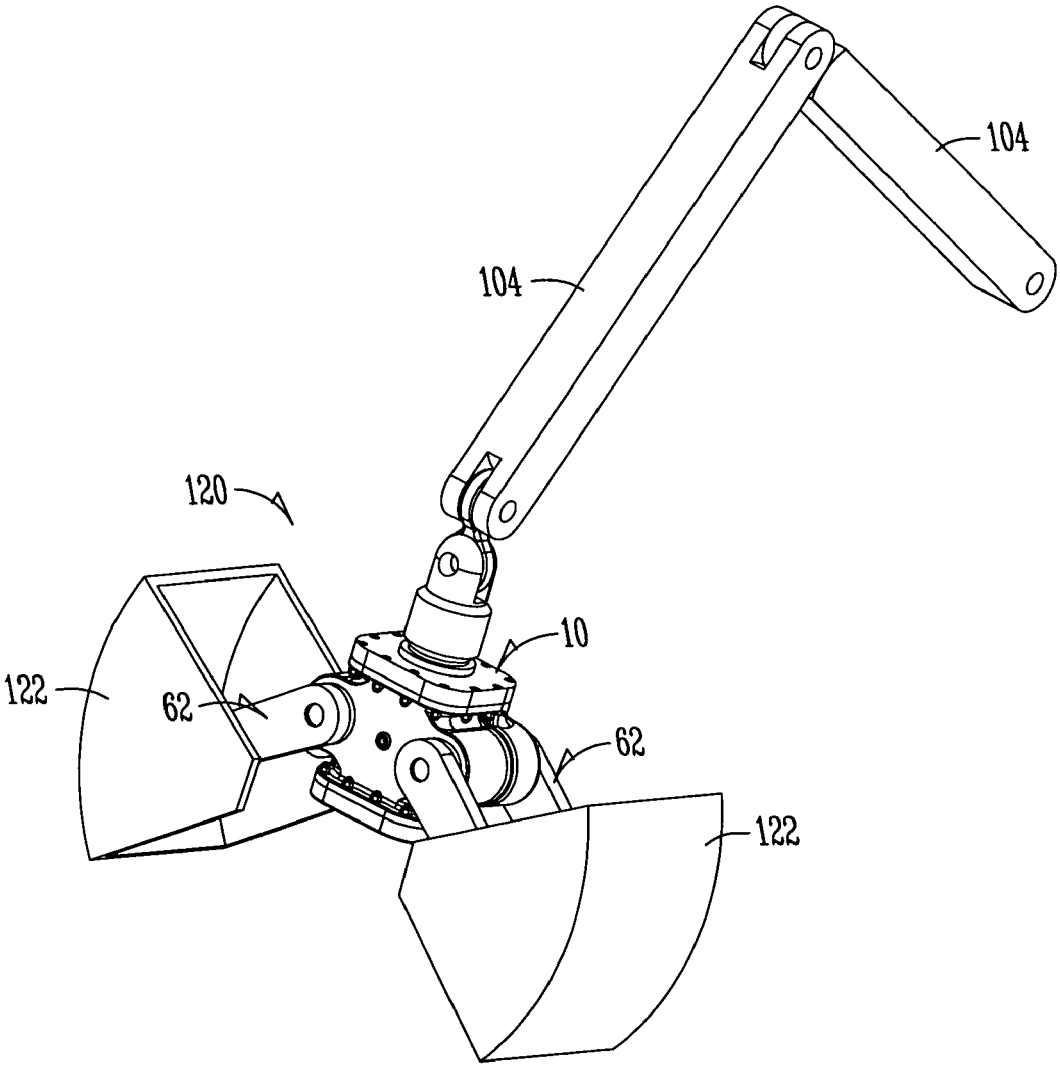
FIG. 9A shows one embodiment of a clamshell grabber assembly opened using the hydraulic actuator.

One embodiment of a clam shell grabber assembly 120 is shown in FIG. 9A. Here, the clam shell grabber assembly 120 comprises two clam shell bucket halves 122 operatively connected to the arm assemblies 62 of the hydraulic actuator assembly 10. The clam shell grabber assembly 120 can then be connected to a machine or vehicle by connecting structure arms 104.

Figures 9B, 9C:
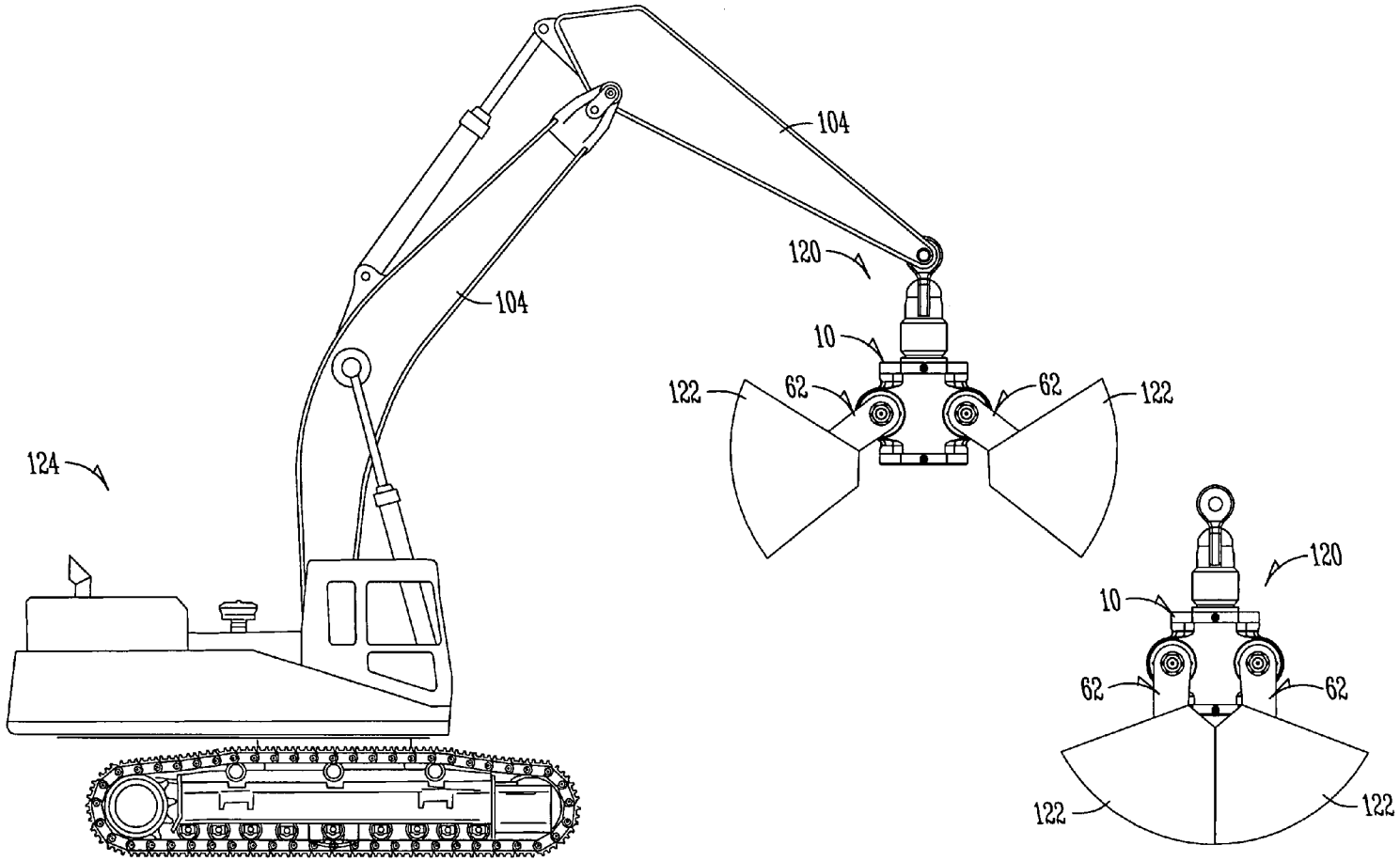
FIG. 9B shows one embodiment of a vehicle with a clamshell grabber assembly using the hydraulic actuator.
FIG. 9C shows another embodiment of a clamshell grabber assembly closed using the hydraulic actuator.

FIG. 9B shows one embodiment of an exemplary clam shell bucket vehicle 124 utilizing the clam shell grabber assembly 120. The clam shell grabber assembly 120 for use on the exemplary clam shell bucket vehicle 124 is shown in FIG. 9C in the closed position.

The hydraulic actuator assembly 10 of the current invention as shown and discussed above can be used in many different applications. The hydraulic actuator assembly 10 can be incorporated into stationary equipment, mobile equipment, vehicles, or any other application.

The benefits of the current invention over the prior art are many. However, a couple of noteworthy benefits are the fact that dual motion hydraulics can be created in a much smaller linear distance over the prior art.

Another major benefit of the current invention over the prior art is the fact that the hydraulic moving parts are contained within a housing. This significantly reduces opportunities for dust, dirt, grease, and etc. from damaging the operation of the hydraulic actuator assembly.

Another benefit of the current invention is that when used for grabbing or grappling applications it creates relatively constant torque throughout the range of motion. Other typical grabbing mechanisms use cylinders to push and pull the arms in and out and the torque is not constant through the motion. This more constant torque feature allows for more precise control during grabbing functions.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A hydraulic actuator comprising:

a rack assembly positioned within a housing;

the rack assembly configured to move linearly within the housing;

the rack assembly comprising at least one set of gear teeth;

the rack assembly further comprising a rack gland operatively connected to the rack assembly so that it will slide when a greater hydraulic force is exerted on one side of the gland than is exerted on the other side of the gland, wherein the rack gland is configured as a rigid, longitudinal, annular member with a first end, a second end, and a sidewall, the annular member is open on the first end and substantially closed on the second end forming an inside and an outside of the annular member, and the annular member is further configured with a lip extending from the annular member around the outside of the first end, and the hydraulic actuator further configured so that a fluid exerts pressure on the inside of the second end of the annular member to move the rack assembly a first direction, the actuator further configured so that a fluid exerts pressure on the outside end of the second end of the annular member and the lip to move the rack assembly opposite the first direction; and at least one pinion gear rotatably situated within the housing so that the pinion gear contacts the set of gear teeth and rotates as the rack assembly moves linearly within the housing.

2. The hydraulic actuator of claim 1 configured so that the rack assembly moves within the housing by force of oil exerting pressure on the rack gland.

3. The hydraulic actuator of claim 1 wherein a portion of the pinion gear extends outside of the housing.

4. The hydraulic actuator of claim 3 further comprising at least one arm operatively connected to the pinion gear.

5. The hydraulic actuator of claim 1 wherein the rack assembly and the rack gland are encased within the housing.

6. The hydraulic actuator of claim 1 wherein the rack gland is configured so that surface area inside the second end of the annular member is less than the surface area outside of the second end of the annular member.

7. The hydraulic actuator of claim 1 wherein the second end of the annular member and the lip are located apart from one another on the annular member.

8. A bi-directional hydraulic actuator comprising:

a piston assembly positioned within a housing;

the piston assembly configured to move linearly within the housing;

the piston assembly comprising a gland operatively connected to the piston assembly;

the gland configured as a rigid longitudinal annular member with a first end, a second end, and a sidewall;

the annular member is open on the first end and substantially closed on the second end forming an inside and an outside of the annular member;

the annular member further configured with a lip extending from the annular member around the outside of the first end, and the bi-directional hydraulic actuator configured so that a fluid exerts pressure on the inside of the second end of the annular member to move the piston assembly a first direction, and the actuator further configured so that a fluid exerts pressure on the outside end of the second end of the annular member and the lip on the first end to move the piston assembly opposite the first direction.

9. The bi-directional hydraulic actuator of claim 8 wherein at least one shaft is operatively connected to the piston assembly.

10. The bi-directional hydraulic actuator of claim 9 wherein the shaft extends outside of the housing.

11. A hydraulic clamping vehicle comprising: the vehicle;

the vehicle configured with an apparatus for clamping items;

the apparatus for clamping items configured with a rack assembly positioned within a housing;

the rack assembly configured to move linearly within the housing;

the rack assembly comprising at least two sets of gear teeth;

the rack assembly further comprising a rack gland operatively connected to the rack assembly so that it will slide when a greater hydraulic force is exerted on one side of the gland than is exerted on the other side of the gland, wherein the rack gland is configured as a rigid longitudinal annular member with a first end, a second end, and a sidewall, the annular member is open on the first end and substantially closed on the second end forming an inside and an outside of the annular member, and the annular member is further configured with a lip extending from the annular member around the outside of the first end; and at least two pinion gears rotatably situated within the housing so that the pinion gears contact the sets of gear teeth and rotate as the rack assembly moves linearly within the housing, at least one arm is operatively connected to each of the pinion gears which move in a clamping motion.

12. A method of creating bi-directional hydraulic motion within a housing comprising the steps of:

providing a housing, a piston assembly, a gland and a fluid;

configuring the housing so the piston assembly moves linearly within the housing;

operatively connecting the gland to the piston so that it will slide when a greater hydraulic force is exerted on one side of the gland than is exerted on the other side of the gland; exerting fluid under pressure on an inside of a second end of an annular member to move the piston assembly a first direction; and exerting fluid under pressure on an outside end of the second end of the annular member and a lip to move the piston assembly opposite the first direction.

13. The method of claim 12 further comprising the step of configuring:

the gland as a rigid longitudinal annular member with a first end, a second end, and a sidewall;

further configuring the annular member as open on the first end and substantially closed on the second end forming an inside and an outside of the annular member; and further configuring the annular member with the lip extending from the annular member around the outside of the first end.

14. A machine having two or more arms, comprising:

the arms operatively connected to a hydraulic actuator, wherein the actuator comprises:

a rack assembly positioned within a housing;

the rack assembly configured to move linearly within the housing;

the rack assembly comprising at least one set of gear teeth;

the rack assembly further comprising a rack gland operatively connected to the rack assembly so that it will slide when a greater hydraulic force is exerted on one side of the gland then is exerted on the other side of the gland, wherein the rack gland is configured as a rigid longitudinal annular member with a first end, a second end, and a sidewall, the annular member is open on the first end and substantially closed on the second end forming an inside and an outside of the annual member, and the annual member is further configured with a lip extending from the annular member around the outside of the first end, and the machine further configured so that a fluid exerts pressure on the inside of the second end of the annular member to move the rack assembly a first direction, the actuator further configured so that a fluid exerts pressure on the outside end of the second end of the annular member and the lip to move the rack assembly opposite the first direction; and at least one pinion gear rotatably situated within the housing so that the pinion gear contacts the set of gear teeth and rotates as the rack assembly moves linearly within the housing.

15. The machine of claim 14 wherein the hydraulic actuator is configured so that the rack assembly moves within the housing by force of oil exerting pressure on the rack gland.

16. The machine of claim 14 wherein a portion of the pinion gear extends outside of the housing.

17. The machine of claim 16 further comprising at least one of the arms being operatively connected to the pinion gear.

18. The machine of claim 14 wherein the rack assembly and the rack gland are encased within the housing.

19. The machine of claim 14 wherein the rack gland is configured so that surface area inside the second end of the annular member is less than the surface area outside of the second end of the annular member.

20. The machine of claim 14 wherein the second end of the annular member and the lip are located apart from one another on the annular member.

21. A hydraulic actuator comprising:

a housing;

a rack assembly positioned within the housing for moving linearly within the housing and having a set of gear teeth;

a rack gland operatively connected to the rack assembly or formed into the rack assembly so that the rack assembly moves linearly within the housing using fluid pressure, wherein the rack gland is configured as a rigid longitudinal annular member with a first end, a second end, and a sidewall, the annular member is open on the first end and closed on the second end forming an inside and an out side of the annular member, the rack gland having a first surface area on the inside of the annular member for the fluid pressure to exert against to move the rack assembly a first direction and the rack gland having a second surface area, on the outside of the annular member, opposite the first surface area and larger than the first surface area for the fluid pressure to exert against to move the rack assembly opposite the first direction; and a pinion gear rotatably situated at least partially within the housing so that the pinion gear contacts the set of gear teeth and rotates as the rack assembly moves within the housing.

* * * * *